US009802802B2

(12) United States Patent
Seljestad

(10) Patent No.: US 9,802,802 B2
(45) Date of Patent: Oct. 31, 2017

(54) WORK TOOL

(71) Applicant: Caterpillar Inc., Peoria, IL (US)

(72) Inventor: Gregory A. Seljestad, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 280 days.

(21) Appl. No.: 14/665,549

(22) Filed: Mar. 23, 2015

(65) Prior Publication Data

US 2016/0280522 A1 Sep. 29, 2016

(51) Int. Cl.
*B66F 9/12* (2006.01)

(52) U.S. Cl.
CPC ..... *B66F 9/12* (2013.01)

(58) Field of Classification Search
CPC ..... B66F 9/12
See application file for complete search history.

(56) References Cited

U.S. PATENT DOCUMENTS

| | | | | |
|---|---|---|---|---|
| 3,851,779 | A * | 12/1974 | Crawford | B66F 9/12 414/667 |
| 4,402,645 | A | 9/1983 | Broderick et al. | |
| 8,939,701 | B2 | 1/2015 | Stewart | |
| 2014/0246272 | A1 | 9/2014 | Szlezak | |

FOREIGN PATENT DOCUMENTS

| | | | |
|---|---|---|---|
| DE | 265050 | A3 * | 2/1989 |
| EP | 0560524 | A1 | 9/1993 |
| EP | 0739854 | B1 | 12/1999 |
| FR | 3014092 | * | 6/2015 |
| GB | 1257488 | A | 12/1971 |
| SE | 417812 | B * | 4/1981 |
| WO | WO 01/70618 | A1 | 9/2001 |

OTHER PUBLICATIONS

English Machine Translation of EP 0739854.*
English Machine Translation of Abstract of SE 417812.*

* cited by examiner

*Primary Examiner* — William E Dondero
*Assistant Examiner* — Diem Tran
(74) *Attorney, Agent, or Firm* — Leydig, Voit & Mayer, Ltd.

(57) ABSTRACT

A work tool for a machine is provided including a laminated member having a plurality of layers of plates. Each plate is arranged in parallel to the other plates and has a face in contacting relation with an opposing face of an adjacent plate. Adjacent plates are secured together by welds along only a portion of an exterior surface of the laminated member. A plurality of pins hold together the plurality of layers of plates. Each pin is received in a respective opening that extends through each plate in the plurality of layers between opposing first and second surfaces of the laminated member.

12 Claims, 5 Drawing Sheets

WORK TOOL

TECHNICAL FIELD

This disclosure relates generally to work tools for machines and, more particularly, to a work tool that can be used to lift a load.

BACKGROUND

Work tools are widely used on machines to lift loads. Forks are one example of a work tool that can be used by a machine to lift a load. The forks can be attached to machines such as lift trucks, telehandlers, skid steer loaders, wheel loaders, track loaders and tractors. Forks generally include a pair of spaced apart tines that can engage and support a load. During use, a load can often be placed on the tines that cannot be lifted off the ground. In such circumstances, the fork is dragged backwards across the ground. The dragging of the fork across the ground can be relatively slow due to the significant amount of friction generated and cumbersome because of debris on the ground. In addition, orienting the arm of the machine carrying the fork to rack or rotate the fork back while dragging the load can cause the arm to come into contact with the ground, which can lead to damage to the arm.

Two common tine constructions are single piece forged tines and laminated tines. Laminated tines typically include multiple layers of metal plates joined together, or laminated, to form the tine. A disadvantage of forged tines is that they provide limited options with regard to the configuration of the tines. Forged tines can also be relatively expensive and can require significant lead times to obtain.

One example of a laminated fork for use with a lift truck is disclosed in EP 560524. The laminated fork includes a plurality of layers that are secured to each other by adhesives or by welding. The weld beads are described as extending along the side edges of the fork for the entire extent of the contact between the adjacent layers. A disadvantage of such laminated tines is that they can be time consuming to manufacture. In particular, securing the multiple layers together that form the laminated tines can require a significant amount of welding. The final finishing and cleaning of these welds can require a substantial amount of time because of the need to smooth out all of the exposed weld joints.

SUMMARY

In one aspect, the disclosure describes a work tool for a machine that includes a laminated member including a plurality of layers of plates. Each plate is arranged in parallel to the other plates and has a face in contacting relation with an opposing face of an adjacent plate. Adjacent plates are secured together by welds along only a portion of an exterior surface of the laminated member. A plurality of pins hold together the plurality of layers of plates. Each pin is received in a respective opening that extends through each plate in the plurality of layers between opposing first and second surfaces of the laminated member.

In another aspect, the disclosure describes a work tool for a machine including a lower leg having a forward end portion and a rear end portion and an upper leg having an upper end portion and a lower end portion. The lower end portion of the upper leg intersects with the rear end portion of the lower leg. A heel extends in a rearward direction away from the intersection of the upper leg and the lower leg. The heel has a lower surface that extends in an upward direction as the lower surface extends away from the intersection of the upper leg and lower leg.

In yet another aspect, the disclosure describes a work tool for a machine including a tine. The tine includes a lower leg having a forward end portion and a rear end portion and an upper leg having an upper end portion and a lower end portion. The lower end portion of the upper leg intersects with the rear end portion of the lower leg with the lower leg and upper leg extending substantially perpendicularly relative to one another. A heel extends in a rearward direction away from the intersection of the upper leg and the lower leg. The tine includes a plurality of layers of plates. Each plate is arranged in parallel to the other plates and has a face in contacting relation with an adjacent plate. Adjacent plates are secured together by a plurality of pins.

DETAILED DESCRIPTION

Figure 1:
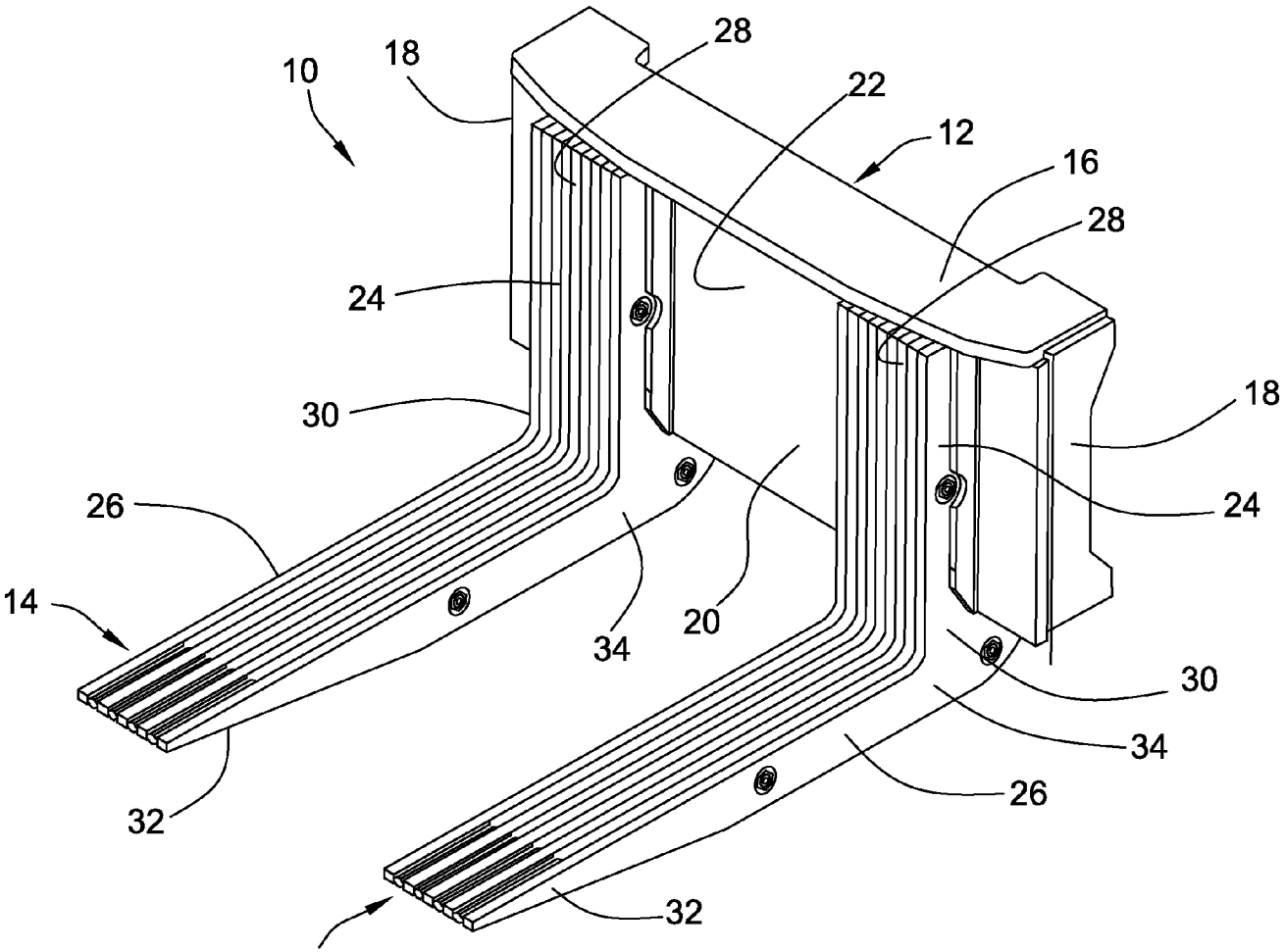
FIG. 1 is an isometric view of a work tool assembly according to the present disclosure.

This disclosure generally relates to work tools for machines. With particular reference to FIG. 1, an exemplary embodiment of a work tool 10 according to the present disclosure is shown. The work tool 10 illustrated in FIG. 1 comprises a fork assembly including at least one tine 14 that may be supported by a frame 12. The work tool 10 may be provided on a machine that is intended to perform some type of operation associated with an industry such as mining, construction, farming, transportation or other industry known in the art. For example, the machine may be a lift truck, telehandler, skid steer loader, wheel loaders, track loader, excavator, backhoe or tractor. In addition, while aspects of the present disclosure may be described in connection with a fork assembly such as shown in FIG. 1, the present disclosure is also applicable to other types of work tools. For example, the present disclosure may be implemented in connection with other types of lifting or loading work tools including differently configured fork assemblies, bucket assemblies, grapples and blades.

The frame 12 supporting the work tool 10 may include a top plate 16, a pair of opposing side plates 18 that are parallel to one another and an intermediate plate 20 that extends between the opposing side plates as shown in FIG. 1. In the illustrated embodiment, the work tool 10 includes a pair of tines 14 that are arranged in parallel, spaced relation to each other on a front face 22 of the frame 12. The tines 14 may be supported on the frame 12 by any suitable method. For example, the tines 14 may be connected to the intermediate plate 20 of the frame 12 by welding. Other methods may also be used to connect the tines 14 to the frame 12 including, for example, fasteners. Moreover, the frame 12 may have a configuration other than that shown in FIG. 1. Similarly, while two tines 14 are shown in FIG. 1, the work tool 10 may have a different number of tines including a single tine or three or more tines and the present disclosure is not intended to be limited to work tools with two tines.

Figure 2:
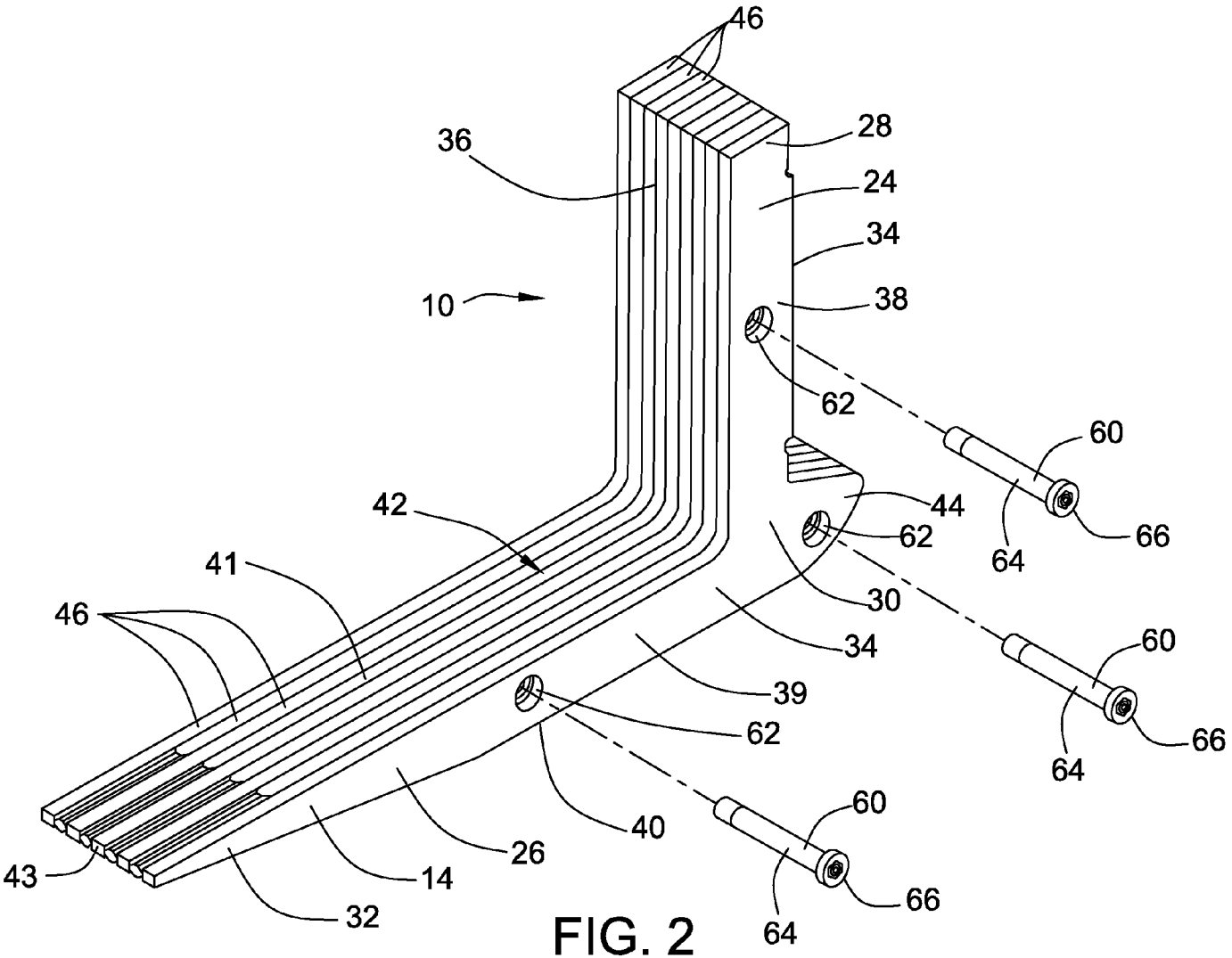
FIG. 2 is an exploded isometric view of one of the tines of the work tool assembly of FIG. 1.
Figure 3:
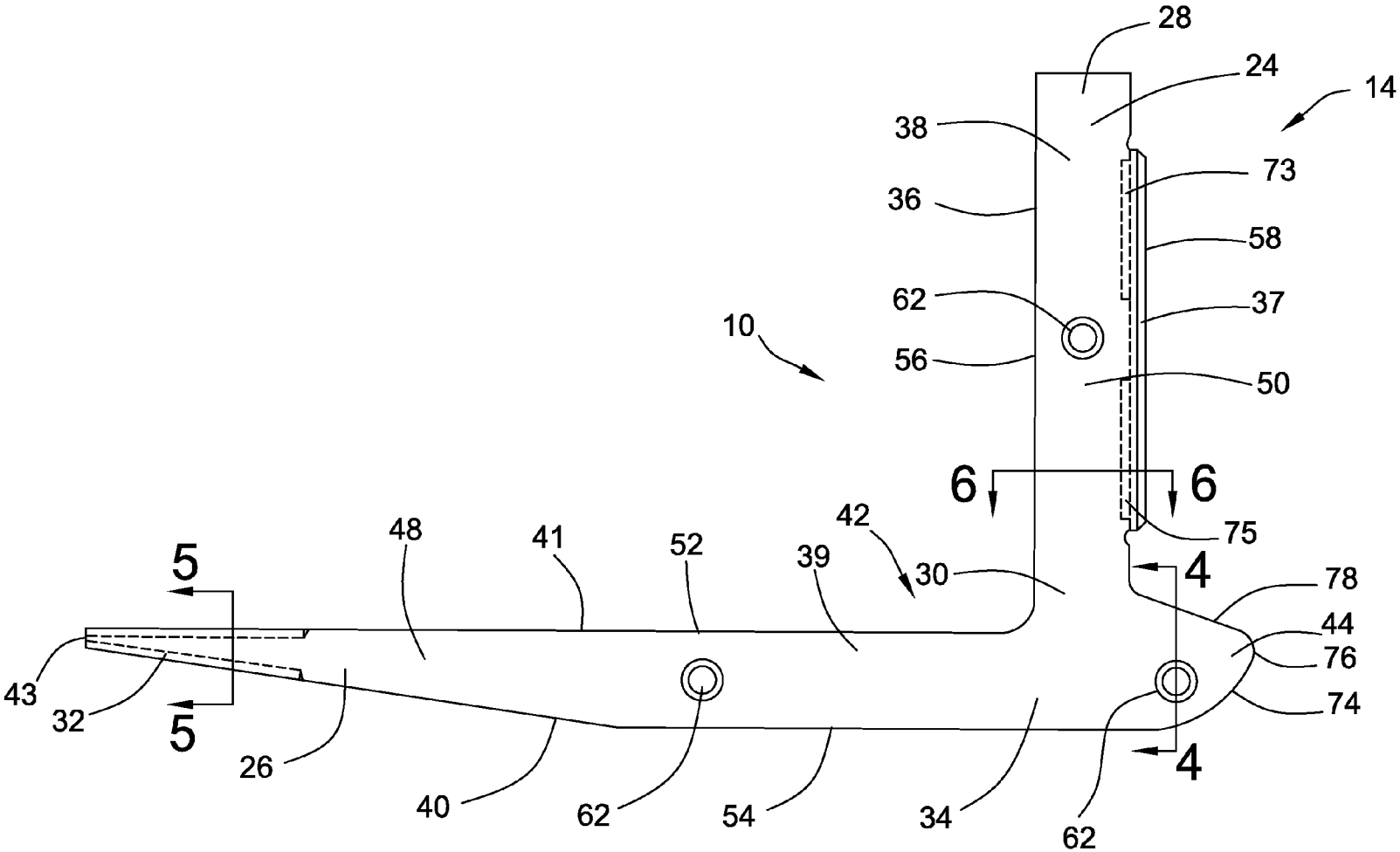
FIG. 3 is a side elevation view of the tine of FIG. 2.

With reference to FIG. 2, one of the tines 14 of the work tool 10 of FIG. 1 is shown. The tine 14 includes an upper leg 24 and a lower leg 26 that intersect with one another at a respective one of the ends of each leg. More particularly, the upper leg 24 may have an upper end portion 28 and a lower end portion 30 and the lower leg 26 may have a forward end portion 32 and a rear end portion 34 with the lower end portion 30 of the upper leg 24 intersecting with the rear end portion 34 of the lower leg 26 with the upper and lower legs extending in perpendicular relation to one another. When connected to a frame 12 such as shown in FIG. 1, the upper leg 24 of the tine 14 may be secured to the frame 12 with the lower leg 26 extending outwardly away from the frame. As shown in FIGS. 2 and 3, the upper leg 24 of the tine 14 may include a front surface 36, a rear surface 37 and opposing side surfaces 38. Likewise, the lower leg 26 of the tine 14 may have opposing side surfaces 39, a lower surface 40 and an upper surface 41. The upper surface 41 of the lower leg 26 of the tine 14 may define a load receiving area 42 (see FIG. 2) upon which a load may be positioned during operation of the work tool 10. Additionally, the forward end portion 32 of the lower surface 40 of the lower leg 26 may angle or taper upward towards the upper surface 41 as the lower surface 40 extends toward the tip 43 of the lower leg 26 as best shown in FIG. 2. As described in more detail below, the tine 14 may further include a heel 44 that extends rearward away from the intersection between the upper and lower legs 24, 26 of the tine 14. When the flat portion of the lower surface 40 of the lower leg 26 of the tine 14 is resting on the ground, the lower leg 26 may extend in a generally horizontal direction and the upper leg 24 may extend in a generally vertical direction.

Figure 5:
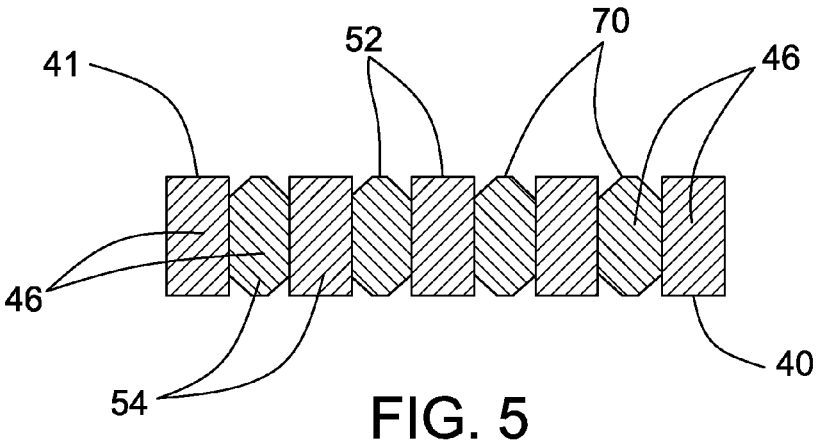
FIG. 5 is a cross-sectional view of the tine of FIG. 2 taken in the plane of the line 5-5 in FIG. 3.
Figure 6:
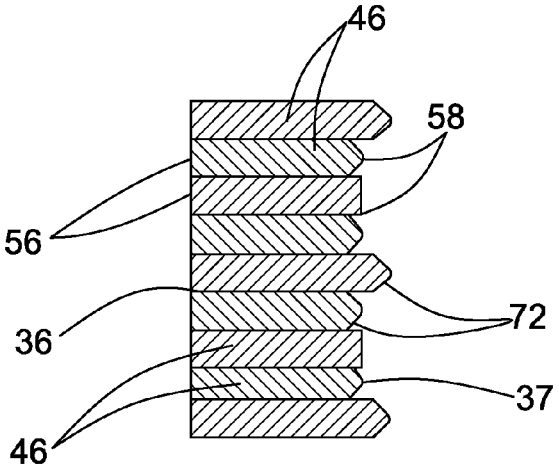
FIG. 6 is a cross-sectional view of the tine of FIG. 2 taken in the plane of the line 6-6 in FIG. 3.

The work tool 10 may include a member, such as the tine 14, having a laminated construction. More specifically, as best shown in FIG. 2, the tine 14 may have a laminated construction that comprises a plurality of layers of plates 46. Each plate 46 may extend parallel to the other plates and include one face that is in a tight fitting contacting relationship with a face of an adjacent plate. In the illustrated embodiment, the plates 46 comprising the individual layers are arranged in side-by-side relation with the outermost plates of the laminated construction defining the lateral side surfaces 38, 39 of the upper and lower legs 24, 26 of the tine 14. In addition, as shown in FIG. 3, each plate 46 includes a lower leg portion 48 that forms part of the lower leg 26 of the tine 14 and an upper leg portion 50 that forms part of the upper leg 24 of the tine. With the arrangement of the plate layers 46 shown in FIG. 2, the respective upper edges 52 of the lower leg portions 48 of the plates 46 making up the laminate construction together form the upper surface 41 of the lower leg 26 of the tine 14 while the respective lower edges 54 of the lower leg portions 48 of the plate together form the lower surface 40 of the lower leg 26 of the tine as shown in FIG. 5. Similarly, as shown in FIG. 6, the respective front edges 56 of the upper leg portions 50 of the plates 46 together form the front surface 36 of the upper leg 24 of the tine while the respective rear edges 58 of the upper leg portions 50 of the plates 46 together form the rear surface 37 of the upper leg 24 of the tine. When the tine 14 is arranged with the flat portion of the lower surface 40 of the lower leg 26 on a flat surface, each of the plates 46 extends in a generally vertical plane.

While generally vertically extending plates 46 are used in the laminate construction shown in FIG. 2, the present disclosure also has applicability to laminate constructions in which the lower leg portion 48 of the plate extends in a horizontal plane and the upper leg portion 50 of the plate extends in a vertical plane. With such a construction, the plates 46 making up the laminate construction would be arranged with the layers comprising the lower leg 26 of the tine 14 being stacked in an array that extends in the bottom to top direction (or vice versa) and the layers comprising the upper leg 24 of the tine being stacked in an array extending in the rear to front direction (or vice versa). This is in contrast to the side-to-side or laterally extending array of the plates 46 of the embodiment of FIG. 2. The illustrated embodiment includes a total of nine plate layers in the laminated construction. However, other numbers of plate layers could be provided. The plates 46 can be constructed of any suitable material including, for example, steel.

Figure 4:
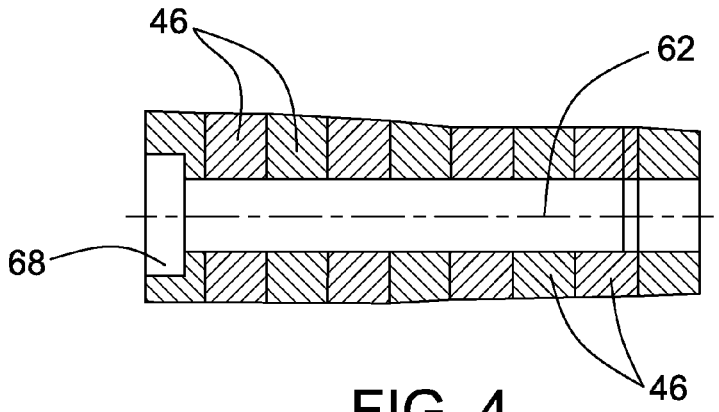
FIG. 4 is a fragmentary cross-sectional view of the tine of FIG. 2 taken in the plane of the line 4-4 in FIG. 3.

The layers of plates 46 that comprise the laminated construction of the tine 14 may be secured together by a plurality of pins 60. The pins 60 are shown exploded out of the tine 14 in FIG. 2. Each pin 60 is received in a respective opening 62 that extends in the lateral or side-to-side direction relative to the tine 14 through each plate 46 of the laminated construction between the opposing side surfaces 38, 39 of the upper and lower legs 24, 26 of the tine. The full extent of one of the openings 62 can be seen in FIG. 4. Each of the pins 60 may include a cylindrical shank portion 64 and an enlarged head portion 66 (see FIG. 2). The enlarged head portion 66 of each pin 60 may be received in a counterbore 68 (see FIG. 4) formed at one end of the respective pin-receiving opening 62. The pins 60 may be press fit in their respective openings by, for example, a hydraulic press. In the illustrated embodiment, one pin 60 extends through the upper leg 24 of the tine 14, one pin 60 extends through the lower leg 26 of the tine and one pin 60 extends through the heel 44 of the tine. A different number and/or arrangement of pins 60 may also be used such as, for example, with tines of different size and/or configuration.

In addition to the pins 60, the layers of plates 46 may be further secured together by welds. However, because of the pins 60, welds may be provided only along a portion of the exterior surface of the tine 14. In particular, adjacent plates 46 may be connected together by welds along only a portion of the exterior surface of the tine 14. For example, in the illustrated embodiment, welds may be provided only on the upper and lower surfaces 41, 40 of the tip or forward end portion 32 of the lower leg 26 and along a portion of the rear surface 37 of the upper leg 24 of the tine 14. As shown in FIG. 5, some of the layers of plates 46 in the tip or forward end portion 32 of the lower leg 26 may have beveled corners 70. In particular, in the illustrated embodiment, the forward end portion 32 of the lower leg 26 has alternating layers of plates with beveled corners 70 at their upper and lower edges 52, 54. These beveled corners 70 provide additional surface area for welds along the upper and lower surfaces 41, 40 of the forward end portion 32.

A plurality of the plates 46 may also have beveled corners 72 on their rear edge 58 along at least a portion of the upper leg 24. As can be seen in FIG. 6, some but not all of the plates 46 have beveled corners 72 in this area. In addition, some of the plates 46 also have a greater depth than other plates. In the illustrated embodiment, the rear surface 37 of the upper leg 24 of the tine 14 has two sections 73, 75 where a number of the plates 46 have beveled corners 72 and varying depths. These sections 73, 75 can be seen in phantom in FIG. 3. As is the case with the forward end portion 32 of the lower leg 26, the beveled corners 72 on the plates 46 along the rear surface 37 of the upper leg 24 of the tine 14 provide space for welds. The varied depths of the plates 46 also provides further surface area for receiving welds. According to one embodiment, the rear surface 37 of the upper leg 24 of the tine 14 is welded only in those sections in which the beveled corners and varied plate depth are provided. Those skilled in the art will appreciate that the particular pattern of beveled corners and varying plate depth in the forward end portion 32 of the lower leg 26 and along the rear surface 37 of the upper leg 24 is just one example of measures that may be taken to facilitate welding of the plates in these areas.

The heel 44 of the tine 14 may be configured so as to facilitate sliding movement of the tine 14 over the ground particularly in the rearward direction. In particular, as shown in FIG. 3, a lower surface 74 of the heel 44 may be configured as a sled-like surface that makes it easier to move the tine over the ground. For example, the lower surface 74 of the heel 44 may extend in the upward direction as it extends rearward toward a distal end portion 76 of the heel. In the illustrated embodiment, the lower surface 74 of the heel 44 curves in the upward direction. More specifically, the heel 44 of the tine 14 may extend in the rearward direction starting generally from the plane of the rear surface 37 of the upper leg 24 of the tine. From this starting position, the lower surface 74 of the heel 44 may curve upward until it reaches the distal end portion 76, which defines a line that that is generally coplanar with the upper surface 41 of the lower leg 26 of the tine 14. The curved lower surface 74 of the heel 44 may have a constant radius of curvature as it curves upward or the radius of curvature may vary. The distal end portion 76 of the heel 44 may have a rounded transition between the lower surface 74 of the heel and an upper surface 78 of the heel 44 as shown, for example, in FIG. 3.

The upper surface 78 of the heel 44 may extend from the distal end portion 76 back to the rear surface 37 of the upper leg 24 of the tine 14. The upper surface 78 of the heel 44 may extend substantially linearly and angle in an upward direction as it moves in the forward direction from the distal end portion 76 to the rear surface 37 of the upper leg 24. Angling the upper surface 78 of the heel 44 upward can help reduce the stress in the corner formed at the intersection between the lower leg 26 and upper leg 24 of the tine 14.

The configuration of the lower surface 74 of the heel 44, as well as the overall configuration of the heel 44, may vary depending, for example, on the size and/or configuration of the tine and/or the intended use for the tine. For example, the heel 44 may extend relatively more or less rearward than as shown in the drawings. The profile of the lower surface 74 of the heel 44 also may vary such as by using a different radius of curvature, multiple radii of curvature and/or linear sections.

INDUSTRIAL APPLICABILITY

The work tool 10 of the present disclosure is applicable for use with any type of machine and particularly those machines that are used for lifting objects. The use of pins 60 to secure the plates 46 of the laminated construction of the tine 14 can substantially reduce the amount of welding need to hold the plates layers together. Moreover, reducing the amount of welding has the further effect of reducing the need for the associated clean-up of the welds after they are applied. Thus, the pins can substantially reduce the amount of time required to manufacture the tine.

Figure 7:
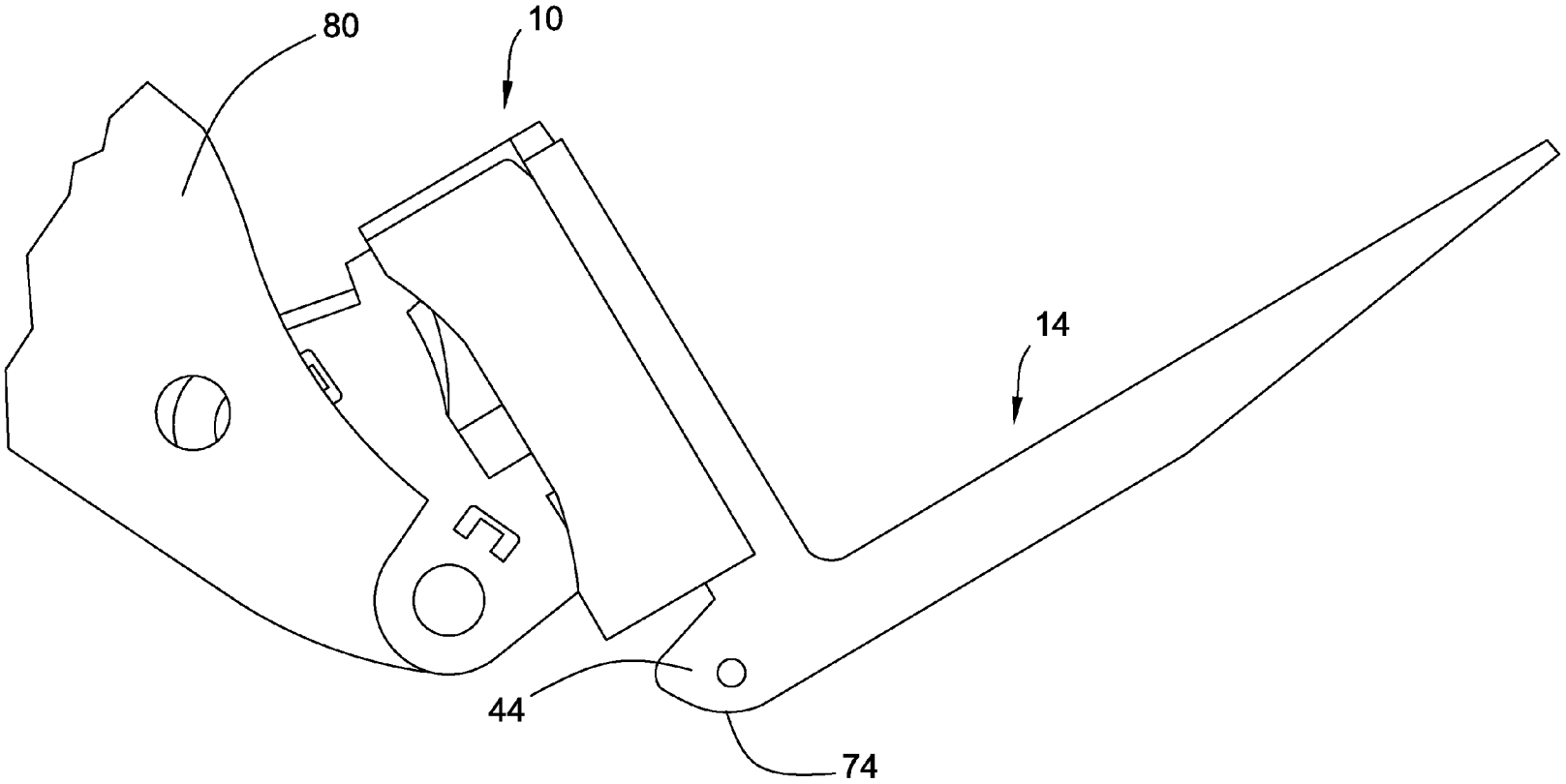
FIG. 7 is a diagrammatic side view of the work tool of FIG. 1 as supported by an exemplary machine arm and in an angled back position for supporting a load.

The use of a laminated construction can also facilitate producing tines in a greater variety of configurations as compared, for example, to forged tines. For example, the laminated construction can allow for the provision of a heel 44 with a contoured lower surface 74 that enables the tine to be slid over the ground much more easily. Additionally, as shown in FIG. 7, when dragging a heavy load over the ground on the tine 14, the contoured heel 44 can allow the tine 14 to be angled farther rearward toward an arm 80 supporting the tine 14 without the arm 80 contacting the ground as compared to tines without a contoured heel. This provides the load with greater stability while avoiding any damage to the arm manipulating the tine.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A work tool for a machine comprising:

a laminated member including a plurality of plates, each plate of the plurality of plates being arranged in parallel and having a face in contacting relation with an opposing face of an adjacent plate; and a plurality of pins that hold together the plurality of plates, each pin being received in a respective opening that extends through each plate in the plurality of plates between opposing first and second surfaces of the laminated member, wherein the laminated member includes a lower leg having a forward end portion and a rear end portion and an upper leg having an upper end portion and a lower end portion, the lower end portion of the upper leg intersecting with the rear end portion of the lower leg, and wherein at least one pin extends through the upper leg and at least one pin extends through the lower leg.

2. The work tool of claim 1 wherein the lower leg and the upper leg extend perpendicularly relative to each other.

3. The work tool of claim 1 further including a heel portion extending in a rearward direction away from the intersection of the upper leg and the lower leg.

4. The work tool of claim 3 wherein the heel portion has a lower surface that extends in an upward direction as the lower surface extends rearward away from the intersection of the upper leg and the lower leg.

5. The work tool of claim 4 wherein at least one pin extends through the heel.

6. The work tool of claim 5 wherein the lower surface of the heel curves upward as it extends rearward from the intersection of the upper leg and lower leg.

7. The work tool of claim 6 wherein an upper surface of the heel extends upward from the distal end portion to a rear surface of the upper leg.

8. The work tool of claim 7 wherein the plates are held together by a plurality of pins with each pin being received in a respective opening that extends through each plate in the plurality of layers.

9. The work tool claim 8 wherein one of the plurality of pins extends through the lower leg, one of the plurality of pins extends through the upper leg and one of the plurality of pins extends through the heel.

10. The work tool of claim 1 wherein each plate of the plurality of plates is oriented such that an edge of each of the plates together form an upper load receiving area of the lower leg.

11. The work tool of claim 1 wherein the pins are press fit in their respective openings.

12. The work tool of claim 11 wherein the lower surface curves upward to a distal end portion that is substantially coplanar with an upper surface of the lower leg.

* * * * *